US010047460B2

(12) United States Patent
Bauer

(10) Patent No.: US 10,047,460 B2
(45) Date of Patent: Aug. 14, 2018

(54) TEXTILE FABRICS WITH COLOR EFFECT

(71) Applicant: SATTLER SUN-TEX GMBH, Goessendorf (AT)

(72) Inventor: Wolfgang Bauer, Graz (AT)

(73) Assignee: SATTLER SUN-TEX GmbH, Goessendorf (AT)

( * ) Notice: Subject to any disclaimer, the term of this patent is extended or adjusted under 35 U.S.C. 154(b) by 606 days.

(21) Appl. No.: 13/724,340

(22) Filed: Dec. 21, 2012

(65) Prior Publication Data

US 2014/0030949 A1 Jan. 30, 2014

(30) Foreign Application Priority Data

Dec. 21, 2011 (AT) ..... A 50016/2011

(51) Int. Cl.

| | |
|---|---|
| ***D06M 23/00*** | (2006.01) |
| ***D06M 15/59*** | (2006.01) |
| ***D06M 15/227*** | (2006.01) |
| ***D06M 15/233*** | (2006.01) |
| ***D03D 15/00*** | (2006.01) |
| ***D03D 1/00*** | (2006.01) |
| ***D03D 13/00*** | (2006.01) |

(52) U.S. Cl.

CPC ..... *D03D 15/0033* (2013.01); *D03D 1/007* (2013.01); *D03D 13/008* (2013.01); *D03D 15/0088* (2013.01); *D10B 2321/10* (2013.01); *D10B 2505/12* (2013.01); *D10B 2505/18* (2013.01); *Y10T 442/3976* (2015.04)

(58) Field of Classification Search

USPC ..... 442/208

See application file for complete search history.

(56) References Cited

U.S. PATENT DOCUMENTS

| | | | | |
|---|---|---|---|---|
| 4,014,084 A * | 3/1977 | Bauer et al. | ..... | 28/255 |
| 4,100,725 A * | 7/1978 | Magel | ..... | D02G 1/164 28/276 |
| 4,140,844 A | 2/1979 | Lohwasser | | |
| 5,385,774 A | 1/1995 | Cramer et al. | | |
| 5,678,881 A * | 10/1997 | Tokarz | ..... | B60J 7/185 292/DIG. 5 |
| 6,706,651 B2 * | 3/2004 | Hamajima | ..... | D01F 8/12 442/192 |
| 2005/0022493 A1 * | 2/2005 | Olinger | ..... | D02G 3/38 57/228 |
| 2009/0111348 A1 * | 4/2009 | Shoyama | ..... | 442/414 |
| 2011/0197508 A1 | 8/2011 | Swennen et al. | | |

FOREIGN PATENT DOCUMENTS

| | | | | |
|---|---|---|---|---|
| DE | 20 18 019 | | 10/1971 | |
| DE | 26 58 916 | | 7/1978 | |
| DE | 29 02 905 | | 7/1980 | |
| DE | 0 285 341 | | 10/1988 | |
| DE | 39 00 846 | | 7/1990 | |
| DE | 39 25 893 | | 2/1991 | |
| DE | 10 2006 004 681 | | 8/2007 | |
| DE | 10 2008 022 577 | | 11/2009 | |
| DE | 10 2008 022 578 | | 11/2009 | |
| DE | 102008022577 | A1 * | 11/2009 | ..... B60J 7/12 |
| DE | 20 2010 003 899 | | 4/2011 | |
| GB | 2040327 | * | 8/1980 | ..... D03D 15/00 |
| WO | 2010/026227 | | 3/2010 | |

OTHER PUBLICATIONS

"Changeant," Lexicon der Gewebe, Thomas Meyer zur Capellen, CP007921555, ISBN: 978-3-86641-258-3, pp. 58,59 (Nov. 30, 2011).

Austrian Office Action in counterpart Austrian Appln. No. 2A A 50016/2011 (dated Sep. 13, 2012).

European Search Report in counterpart European Appln. No. 121 98 849.7-1710 (dated Mar. 7, 2013).

"Spinnfärbung," Lexicon der Gewebe, Thomas Meyer zur Capellen, CP007921555, ISBN: 978-3-86641-258-3, pp. 346, 347 (Nov. 30, 2011) (w/ Partial machine translation).

European Search Report in counterpart European Appln. No. 121 98 849.7-1710 (dated Jun. 30, 2016).

* cited by examiner

*Primary Examiner* — Lynda Salvatore

(74) *Attorney, Agent, or Firm* — Greenblum & Bernstein, P.L.C.

(57) ABSTRACT

The invention relates to a textile fabric having a woven fabric, which is made up in whole or in part of flat filament yarns, wherein warp threads and weft threads form the woven fabric and wherein the warp threads and the weft threads are each made of a polymer. The invention provides that the warp threads and the weft threads are spun dyed and are different colors, which produce a varying color of the woven fabric depending upon a viewing angle.

24 Claims, No Drawings

TEXTILE FABRICS WITH COLOR EFFECT

The invention relates to a textile fabric having a woven fabric, which is made up in whole or in part of flat filament yarns, wherein warp threads and well threads form the woven fabric and wherein the warp threads and the well threads are each made of a polymer.

In addition, the invention relates to a use of such a fabric.

Finally, the invention relates to a device having at least one drive and at least one textile fabric, wherein the textile fabric can be moved by the drive.

Textile fabrics are supposed to create an appealing surface for special applications, for example soft tops of convertible cars or awnings. The so-called design should meet the highest demands especially for applications at the high end of the market. At the same time, however, durability is required, because corresponding textile fabrics are frequently utilized or used in outside areas and are therefore subject to various influences which could rapidly have an undesirable effect on the textile fabric, resulting in the former appealing nature of the surface being lost. These include, in particular, the effects of weather, ozone and solar radiation or UV light.

Various textile fabrics are known from the prior art for convertible cars for example. DE 20 2010 003 899 U1 discloses, among other things, a flexible soft top cover for a soft top of a convertible car, wherein the woven fabric is designed at least in some areas with a panama-like or zigzag-twill-like fabric weave, which is supposed to produce a carbon look. This is meant to produce a high-quality visual appearance. It may also be provided that polyacrylonitriles (PAN) are used as materials and warp threads and well threads are different colors so as to make it easier to obtain a carbon effect.

A textile fabric is known from DE 39 25 893 C2, which may likewise be designed with warp threads and weft threads having different shades of color, wherein the warp yam and the weft yarn may be made of a color combination that is produced by individual filaments that have been dyed differently.

DE 10 2006 004 681 A1 discloses a woven yarn fabric, which can be created using a Jacquard weaving technique, wherein fibers having different colors are used. This is supposed to achieve a plurality of color variations of the woven yarn fabric along with a color fastness of same as compared with the prior art.

DE 10 2008 022 577 A1 discloses a convertible car with a soft top, wherein the woven fabric is assigned weft threads in different colors. One portion of the weft threads is designed for this in a dark base color and another portion of the weft threads in a contrasting color. This alternation is supposed to allow the improvement of a visual impression.

DE 20 18 019 B2 discloses the manufacturing of a blended yarn made of yarn components which are designed to have a two-color character. As a result of the homogeneous blend of or in the yarn components, a perfect distribution of threads is supposed to be achieved over the entire cross section of a blended yarn, thereby achieving a pleasing mixture.

DE 39 00 846 A1 discloses a woven fabric made of PAN, wherein the warp threads and the weft threads may be present as multifilaments.

Within the scope of the present invention, it was recognized that a particularly appealing appearance that is also durable may be achieved in the case of a textile fabric of the type cited at the outset, if the warp threads and the weft threads are spun dyed and are different colors that produce a varying color of the woven fabric depending upon a viewing angle. In particular, because the warp threads and weft threads are different colors in the case of a textile fabric of the type cited at the outset, a visual latent image effect is achieved, i.e., the color of the textile fabric changes in a visually appealing manner depending upon the viewing angle.

Accordingly, one object of the invention is to disclose a textile fabric of the type cited at the outset, which produces a visually appealing surface with varying color and has long-term stability.

A further object of the invention is to represent a use of such a textile fabric.

Finally, the object of the invention is to disclose a device of the type cited at the outset, which is designed with a visually appealing textile fabric having long-term stability.

The first object of the invention is attained according to the invention in that, in the case of a textile fabric of the type cited at the outset, the warp threads and the weft threads are spun dyed and are different colors, which produce a varying color of the woven fabric depending upon a viewing angle.

One advantage achieved with the invention is that a visually appealing textile fabric is made available that has long-term stability even under the effects of weather. In this case, it is important that the textile fabric is formed at least partially of flat filament yams and both the warp threads and the weft threads are spun dyed and are a different color. The flat formation of the filament yarns makes an excellent reflection possible with the incidence of light, which, in conjunction with the different colors of the warp threads and weft threads, in turn ensures a an overall color of the woven fabric that depends upon the viewing angle. In this way, a so-called latent image effect is achieved: If the warp threads are dyed black and the weft threads are dyed green, for example, the woven fabric as a whole appears two-dimensionally at once black and at once green depending upon the viewing angle. At the same time, it is provided that both the warp threads and the weft threads are spun dyed, i.e., a dyeing already takes place in a liquid solution or mixture, resulting in a homogeneous distribution and adherence of the dyes in the individual yams. This makes it possible for the woven fabric and ultimately the textile fabric to hold up well to the effects of weather in particular, and to provide a durability of the product. This can be attributed in particular to a strong adherence of the dyes in the yarns so that UV radiation, moisture or rain or even the effect of ozone is not able to negatively impact the dyes in the yams or make the yarns fade, which would thereby do away with the latent image effect.

The desired latent image effect, along with an excellent resistance to weathering and UV light, is also obtained if merely a portion of the woven fabric is made of filament yarns and the remaining portion of a staple fiber yam, however.

A further advantage is that by using spun dyed warp threads and weft threads according to the invention, it is relatively easy to create the visually appealing textile fabric, because it is possible to eliminate subsequent operations for dyeing individual filament yams or staple fiber yams, which incidentally also would not be expedient.

According to the invention, the warp threads and the well threads may each be made of a polymer. In this case, it may be provided that the warp threads and the well threads are made of different polymers, for example, polyester, polypropylene or other polymers. Depending upon the application, however, it may be preferred that the warp threads and the well threads be made of the same polymer, in particular PAN. This makes it possible to ensure a durability or resistance to weathering of the yams in conjunction with the intended spin dyeing.

It is important that the filament yams, which form the woven fabric alone or together with staple fiber yarn, are configured to be flat. In this case, both individual filaments and multifilaments may be provided. The advantage of multifilaments is that they are especially well suited with respect to a sheen or a reflection and that therefore, according to the invention, it is especially easy to obtain a desired two-dimensionally uniform color of the textile fabric that depends upon the viewing angle. The multifilaments may be formed in this case from approximately 150 to 250, preferably 180 to 220, individual filaments. This is especially preferred with respect to a durability of the textile fabric, even in the case of extreme effects of weather.

A ratio of a warp density to a weft density is generally not critical, but is preferably 1.5 to 2.5 in order to promote as much as possible the intended latent image effect or a color effect that depends upon the viewing angle.

In the case of the use of only filament yams, the textile fabric may be designed such that a fineness of the warp threads and weft threads is 50 to 2000 dtex, in particular 300 to 800 dtex. With a fineness of less than 50 dtex, individual filaments are too thin and processing is difficult. With a fineness of greater than 2000 dtex, the individual filament yams are too thick and processing becomes difficult. There is good processability along with a good value for the money of the filaments in the range of 300 to 800 dtex.

If only filament yams are used, the warp threads and the well threads may generally have the same fineness, even though it may be advantageous for achieving different color effects at different viewing angles if said threads have different finenesses.

The fineness of the warp threads and the well threads may influence an appealing impression or visual appearance of the textile fabric. It is preferred in this regard that a fineness of the warp threads is at least 1.5 times that of the well threads.

A thread count of the warp threads and/or weft threads is generally in the range of 10 to 50 threads per cm.

It is especially preferred that the warp threads and the well threads are interlaced by a twill weave construction, which produces an especially strong dependence of the color of the textile fabric on the viewing angle. This applies primarily to soft tops of convertible cars. However, a plain weave may also be used for other applications, e.g., awnings.

As already mentioned, the warp threads and the weft threads may be made of a filament yam, on the one hand, and a staple fiber yam, on the other hand. It is especially expedient to make the warp threads of a staple fiber yam and the weft threads of a flat filament yarn, because then it is especially easy to manufacture the textile fabric. In the case of such an embodiment, it is also possible to optimally coordinate the visual latent image effect on the one side and resistance to weathering on the other side. The warp threads may be made of PAN and have e.g., a black color. In this embodiment, the warp threads are particularly resistant to the effect of UV light and do not yellow even in a test with a xenon lamp with repeated exposure in several cycles over a total of 350 hours. The weft threads present in this case as filament yarn may be made e.g., of a polyester and be another color. Because of the appropriate combination or configuration and formation of warp threads and weft threads, the desired visual latent image effect is also produced at the same time.

If requirements for resistance to light and weathering are not as high, it is possible for both the warp threads and the weft threads to be made of PAN.

Conversely, it is also generally possible for the warp threads to be made of a flat filament yarn and the weft threads of a staple fiber yarn.

The textile fabric may be formed per se of the woven fabric as such. However, it is advantageous for many applications that the textile fabric is designed with an underfabric to which the woven fabric is connected. In particular, it may be provided that the woven fabric is connected to the underfabric via a rubber layer. This lends the woven fabric, which becomes outwardly visible, a stability required for many applications, for example soft tops of convertible cars or awnings or other devices that are equipped with a drive for moving a length of material that is exposed to external influences such as weather or UV radiation.

In accordance with the advantages described in the foregoing, the further object is attained by the use of a fabric according to the invention for retractable and extendable lengths of material which have a varying color depending upon a viewing angle, in particular soft tops of convertible cars or awnings. In this case, it is especially advantageous that the color of the length of material changes when moving depending upon the viewing angle, which produces an unexpected effect.

The still further object of the invention is attained by a device of the type cited at the outset having a textile fabric according to the invention.

Additional features, advantages and effects of the invention follow from the embodiment examples described below.

EXAMPLE 1

Textile Fabric with Latent Image Effect for a Convertible Car

Weave: 2/1 twill, Z direction
Warp:
PAN multifilament, black, spun dyed, 300 S turns per meter
Fineness: approx. 600 dtex, 200 individual filaments
Warp density: 30 threads per cm
Weft:
PAN multifilament, white, spun dyed, 100 S turns per meter
Fineness: approx. 600 dtex, 200 individual filaments
Weft density: 15 threads per cm A textile fabric having a woven fabric as described above was produced as a length of material for a soft stop of a convertible car equipped with a drive. The corresponding woven fabric was applied to an underfabric, wherein a rubber layer was provided as an intermediate layer and the woven fabric was connected to the rubber layer by means of an adhesive. The textile fabric showed a black or whitish color depending upon the viewing angle. Long-term tests related to resistance to weathering and UV radiation showed no significant change in the visual impression.

EXAMPLE 2

Textile Fabric with Latent Image Effect for a Convertible Car

Weave: 2/1 twill, Z direction
Warp:
PAN staple fiber, black, spun dyed

Fineness: approx. 60 tex
Warp density: 30 threads per cm
Weft:
Polyester multifilament, white, spun dyed, 100 S turns per meter
Fineness: approx. 600 dtex, 200 individual filaments
Weft density: 15 threads per cm As in Example 1, a material for a convertible car was manufactured and exposed in a standardized test to five cycles of an irradiation with a xenon lamp and was then compared to a material according to Example 1. In this case, no yellowing was identified after the irradiation cycles for a material according to Example 2, whereas a material according to Example 1 showed slight indications of yellowing.

EXAMPLE 3

Textile Fabric with Latent Image Effect for Awnings and Outdoor Furniture

Plain Weave
Warp:
PAN staple fiber, green, spun dyed
Fineness: approx. 60 tex
Warp density: 30 threads per cm
Weft:
PAN multifilament, red, spun dyed, 100 S turns per meter
Fineness: approx. 600 dtex, 200 individual filaments
Well density: 15 threads per cm A textile fabric made exclusively of PAN was used to manufacture an awning as well as covers for outdoor furniture and exposed to weather conditions over a longer period of time, whereby no weather-related changes were identifiable on the textile.

CROSS REFERENCE TO PRIORITY APPLICATION

This application claims priority under 35 U.S.C § 119(a) to Austrian Patent Application No. A 50016/2011 filed Dec. 21, 2011, the disclosure of which is expressly incorporate by reference herein in its entirety.

The invention claimed is:

1. Textile fabric having a woven fabric, comprising:
in whole or in part flat filament yarns, in which warp threads and weft threads form the woven fabric;
the warp threads and the weft threads are each made of a polymer, and
all of the warp threads are spun dyed a first color and all of the weft threads are spun dyed a second color that is different from the first color, whereby the woven threads of different colors produce a perceived color for the woven fabric that varies depending upon a viewing angle.

2. Textile fabric according to claim 1, wherein the warp threads and the weft threads are made of the same polymer.

3. Textile fabric according to claim 1, wherein the warp threads and the weft threads are each made of polyacrylonitrile.

4. Textile fabric according to claim 1, wherein the warp threads and the weft threads are designed as multifilaments.

5. Textile fabric according to claim 4, wherein the multifilaments are formed respectively from approximately 150 to 250 individual filaments.

6. Textile fabric according to claim 4, wherein a ratio of a warp density to a weft density is 1.5 to 2.5.

7. Textile fabric according to claim 4, wherein a fineness of the warp threads and the weft threads is 50 to 2000 dtex.

8. Textile fabric according to claim 4, wherein the warp threads and the weft threads have a different fineness.

9. Textile fabric according to claim 1, wherein a fineness of the warp threads is at least 1.5 times that of the weft threads.

10. Textile fabric according to claim 1, wherein a thread count of the warp threads and/or weft threads is 10 to 50 threads per cm.

11. Textile fabric according to claim 1, wherein the warp threads and the weft threads are interlaced by a twill weave construction.

12. Textile fabric according to claim 1, wherein the warp threads are made of a staple fiber yarn and the weft threads of a flat filament yarn.

13. Textile fabric according to claim 12, wherein the warp threads are made of polyacrylonitrile.

14. Textile fabric according to claim 12, wherein the weft threads are made of a polyester.

15. Textile fabric according to claim 12, wherein the warp threads and the weft threads are made of polyacrylonitrile.

16. Textile fabric according to claim 1, wherein the warp threads are made of a flat filament yarn and the weft threads of a staple fiber yarn.

17. Textile fabric according to claim 1, wherein an underfabric is provided to which the woven fabric is connected.

18. Textile fabric according to claim 17, wherein the woven fabric is connected to the underfabric via a rubber layer.

19. A textile fabric according to claim 1 for retractable and extendable lengths of material which have a perceptible color that varies depending upon a viewing angle, the textile fabric being configured as one of soft tops of convertible cars or awnings.

20. A device comprising:
at least one drive; and
at least one textile fabric designed according to claim 1, wherein the at least one textile fabric is movable by operation of the drive.

21. Textile fabric according to claim 5, wherein the multifilaments are formed respectively from 180 to 220 individual filaments.

22. Textile fabric according to claim 7, wherein the fineness of the warp threads and the weft threads is 300 to 800 dtex.

23. A woven textile fabric, comprising:
flat filament yarns that are made of a polymer and that are arranged as warp threads and weft threads that are woven together; and
the warp threads are spun dyed one color consisting of a first color and the weft threads are spun dyed another color consisting of a second color different from the first color so that, when woven together, a perceived color of the woven flat filament yarns varies depending upon a viewing angle of the woven flat filament yarns.

24. A method of forming the textile fabric according to claim 1, the method comprising:
spin dying the warp threads the first color and the weft threads the second color different from the first color; and
weaving together the spun dyed warp threads of the first color and the weft threads of the second color different from the first color to form the woven fabric, whereby the perceived color of the woven fabric varies depending upon a viewing angle of the woven fabric.

* * * * *